US010583965B2

(12) United States Patent
Walsak

(10) Patent No.: US 10,583,965 B2
(45) Date of Patent: Mar. 10, 2020

(54) CLOSURE DEVICE FOR A SCREW TOP VESSEL

(71) Applicant: StoneHusk, LLC, Wilmington, NC (US)

(72) Inventor: Dennis Michael Walsak, Wilmington, NC (US)

( * ) Notice: Subject to any disclaimer, the term of this patent is extended or adjusted under 35 U.S.C. 154(b) by 8 days.

(21) Appl. No.: 16/043,812

(22) Filed: Jul. 24, 2018

(65) Prior Publication Data

US 2019/0241323 A1 Aug. 8, 2019

Related U.S. Application Data

(60) Provisional application No. 62/627,327, filed on Feb. 7, 2018.

(51) Int. Cl.

| | |
|---|---|
| ***B65D 39/00*** | (2006.01) |
| ***B65D 45/24*** | (2006.01) |
| ***B65D 45/06*** | (2006.01) |
| ***B65D 47/08*** | (2006.01) |
| ***B65D 41/04*** | (2006.01) |

(52) U.S. Cl.

CPC ..... *B65D 39/0035* (2013.01); *B65D 41/0435* (2013.01); *B65D 45/06* (2013.01); *B65D 45/24* (2013.01); *B65D 47/08* (2013.01); *B65D 2251/0012* (2013.01); *B65D 2251/0078* (2013.01); *B65D 2251/023* (2013.01); *B65D 2251/1058* (2013.01); *B65D 2251/1075* (2013.01)

(58) Field of Classification Search

CPC ..... B65D 39/0035; B65D 41/0435; B65D 2251/0078; B65D 2251/1058; B65D 2251/023; B65D 2251/1075; B65D 2251/0012; B65D 45/24; B65D 47/08; B65D 45/06

USPC ..... 215/235, 239

See application file for complete search history.

(56) References Cited

U.S. PATENT DOCUMENTS

| | | | | |
|---|---|---|---|---|
| 158,406 | A | 1/1875 | DeQuillfeldt | |
| 603,724 | A * | 5/1898 | Broome | B65D 45/24 215/239 |
| 1,369,477 | A | 2/1921 | Simenowsky | |
| 1,481,505 | A * | 1/1924 | Crass | B65D 45/24 501/83 |

(Continued)

FOREIGN PATENT DOCUMENTS

| | | |
|---|---|---|
| DE | 202014008591 U1 | 12/2014 |
| DE | 202016006324 U1 | 1/2017 |

(Continued)

*Primary Examiner* — James N Smalley

(74) *Attorney, Agent, or Firm* — Carla Gannon Law

(57) ABSTRACT

A closure device includes a stopper assembly that provides swing-top closure of a vessel, plus an adaptor so the device can be used with screw-top vessels. The stopper assembly is connected to the adaptor by two connected wires: a bail wire that connects to the stopper assembly, and a lever wire that connects to the adaptor. The inner circumference of the adaptor defines a plurality of vessel threads that engage with the threads defined by the neck of a screw-top vessel. The lever wire is readily removable from the adaptor in order to secure the protruding portions of the lever wire beneath the stop ring of the vessel.

11 Claims, 12 Drawing Sheets

(56) References Cited

U.S. PATENT DOCUMENTS

| | | | | | |
|---|---|---|---|---|---|
| 1,592,737 | A * | 7/1926 | Kuebbeler | B65D 45/24 | 215/284 |
| 2,092,964 | A * | 9/1937 | Fernberg | B65D 35/42 | 222/512 |
| 4,746,027 | A * | 5/1988 | Coker | B65D 45/22 | 215/293 |
| D682,612 | S | 5/2013 | Rzepecki | | |
| 2017/0015465 | A1* | 1/2017 | Raupach | B65D 21/0217 | |
| 2017/0283131 | A1 | 10/2017 | Watkins et al. | | |

FOREIGN PATENT DOCUMENTS

| | | | |
|---|---|---|---|
| EP | 2025602 | A1 | 2/2009 |
| EP | 2143656 | B1 | 1/2013 |
| EP | 3122649 | B1 | 3/2018 |
| NL | 1030813 | | 12/2005 |

* cited by examiner

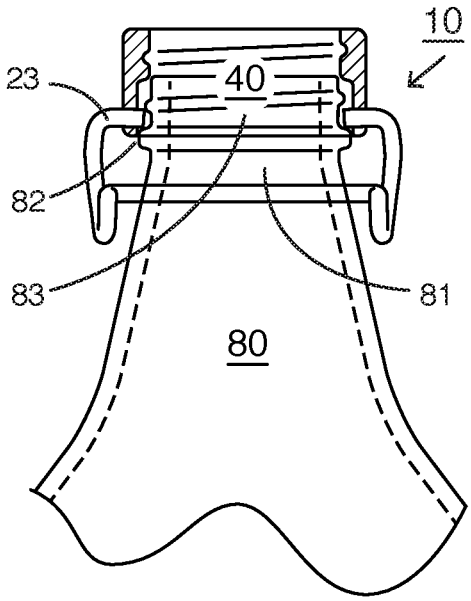
FIG. 12A
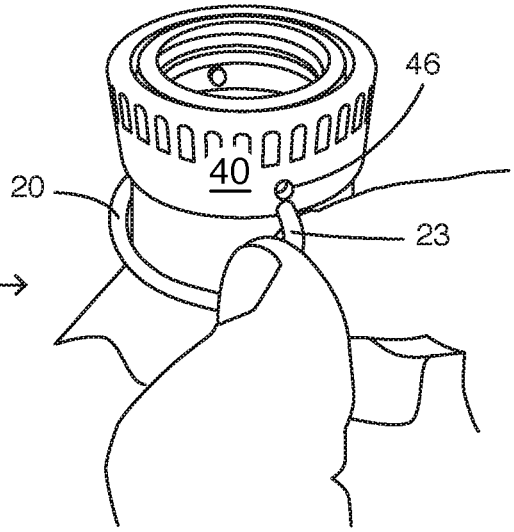
FIG. 12B
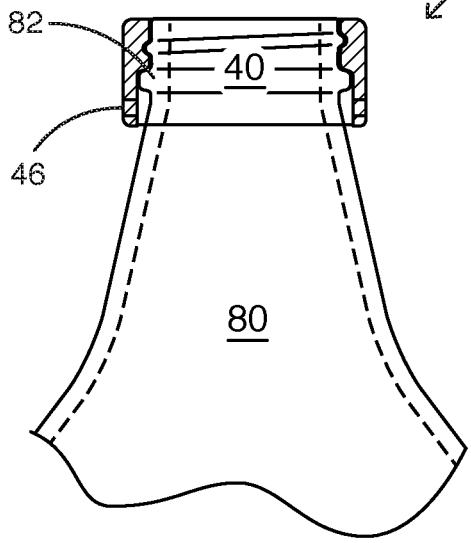
FIG. 12C
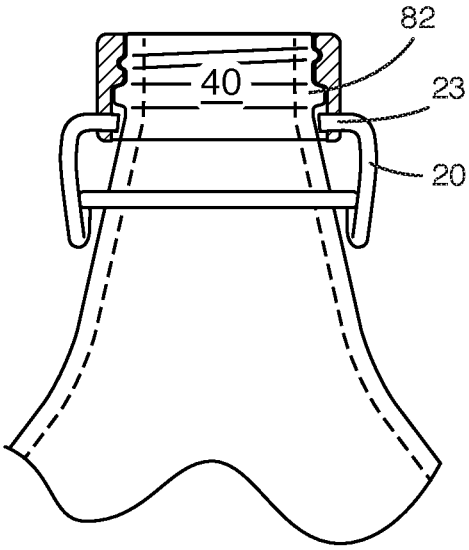
FIG. 12D
FIG. 12

CLOSURE DEVICE FOR A SCREW TOP VESSEL

CROSS-REFERENCE TO RELATED APPLICATIONS

This application claims priority from the United States provisional patent application entitled IMPROVED METHOD AND APPARATUS REGARDING LIQUID CONTAINER, which was filed on Jul. 3, 2017, and assigned the Ser. No. 62/627,327. This non-provisional application was filed more than 12 months after the thing date of the provisional application, but within 14 months after the filing date of the provisional application, with the benefit of the provisional application restored under 37 CFR 178.

BACKGROUND OF THE INVENTION

The present invention relates to vessel closure devices, and more specifically, to a swing-top closure device for use with screw-top vessels.

There are a variety of devices for transporting draft beer, generally referred to as growlers. These devices are generally air-tight containers or vessels made of glass, ceramic or stainless steel and have either a screw-on top or a hinged porcelain gasket swing-top stopper.

Bottle closures are necessary for lessening the threat of spillage and/or spoiling of the beer, wine, spirit or other liquid contained inside a vessel, and come in many shapes, sizes, colors and materials. The right closure is a crucial element to preserving freshness and taste.

Screw caps are effective for containing the liquid inside of vessels, but oftentimes, if not applied or maintained properly, these caps can leak allowing air into the vessel, or gas out of the vessel, thereby damaging the product. Too much application torque can damage the cap or strip bottle threads, and too little torque may allow the cap to leak or vibrate loose during transport. Also, once the sealant on these screw caps begins to wear off, they can no longer be used effectively.

One solution to keep screw-top vessels from leaking is to use proper cap application and maintenance, keeping caps clean and free of debris, and making sure that when the manufacturer sealant begins to wear off the cap will no longer be used. Ideally, the cap should be thrown out between each use, but often that isn't cost effective. In short, a downside of screw-top vessels is the eventual failure of the cap, cost of cap replacement, and/or requirement of ongoing monitoring of cap integrity.

Vessels equipped with swing-top stoppers are desirable because they provide a secure seal to preserve freshness and taste longer, can be used multiple times before needing to be replaced, and are aesthetically pleasing in appearance. However, swing-top stoppers can only be used with compatible vessels, typically a vessel with a smooth spout but a circumferential ridge, or stop ring, capable of securing the lever wire and/or bail wire assembly in position when closed. Standard screw-top vessels with threaded lips are not compatible with standard swing-top stoppers. As used herein, "swing-top stopper" and the like, which typically have a bail wire in the center axis, shall generically also refer to "flip-top stoppers", which typically have the bail wire on a side axis.

Screw-top vessels are a common design for beer growlers, in spite of the shortcomings of using screw caps as described above. Their popularity is largely based on availability, low cost, and ease of use of standard threaded glass vessels. Not surprisingly, screw-tops are standardly used with screw-top vessels due to compatibility. However, swing-top stoppers are actually superior closure devices with beer growlers, particularly due to swing-top stopper's ability to create a substantially gas impermeable seal.

As can be seen, it is desirable to combine the benefits of a screw-top vessel with the benefits of a swing-top stopper. It is desirable to have a closure system including a screw-top vessel with a swing-top stopper. It is desirable to have a closure device capable of converting a conventional screw-top vessel into a swing-top vessel. It is desirable that these devices and systems are efficient, inexpensive to manufacture and transport, easy to use, and can be used with a variety of screw-top vessels.

BRIEF DESCRIPTION OF THE DRAWINGS

FIG. 12 depicts use of closure device, with:

FIG. 12A showing the stop ring impeding protruding portion of lever wire;

FIG. 12B showing a user removing lever wire from aperture;

FIG. 12C showing adaptor screwed onto vessel with apertures below stop ring; and FIG. 12D showing lever wire reinserted into adaptor.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

As used herein, the following terms shall refer to the stated structures among the various FIGS:

10—Closure device;
15—Closure system;
20—Lever wire;
23—Protruding portion;
25—Loop;
27—Handle;
30—Bail Wire;
32—Central portion;
33—Lateral portion;
34—Engaging termini;
40—Adaptor;
42—Gripping divot;
44—Threads;

46—Apertures;
47—Inner circumference;
48—Outer circumference;
50—Stopper assembly:
60—Lid;
62—Upper surface;
64—Indentations;
66—Groove;
67—Wide base;
68—Covered region;
70—Plug;
80—Vessel;
81—Neck;
82—Stop ring; and
83—Vessel threads.

Figure 1:
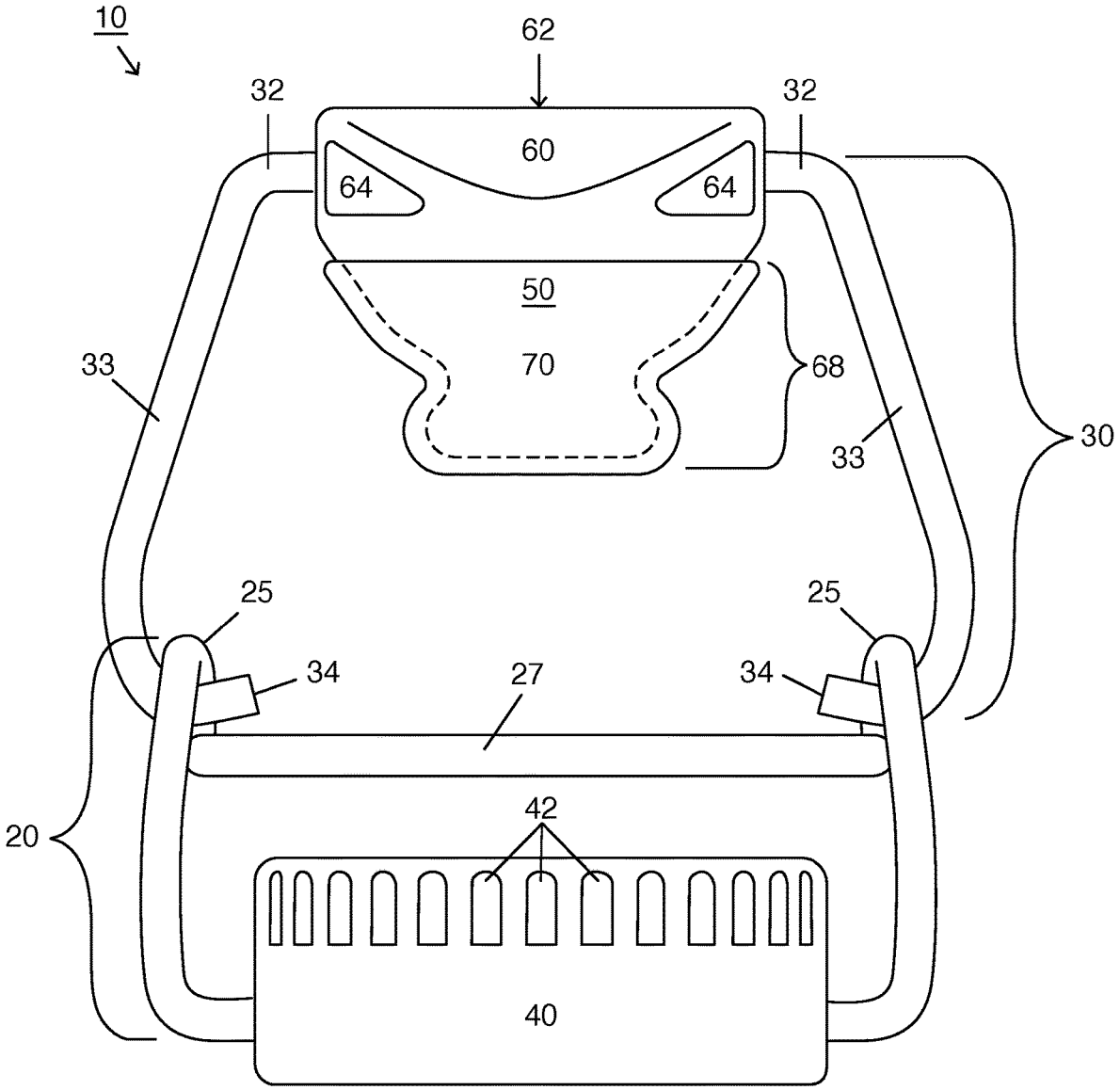
FIG. 1 is a front view of a closure device of the present invention.
Figure 2:
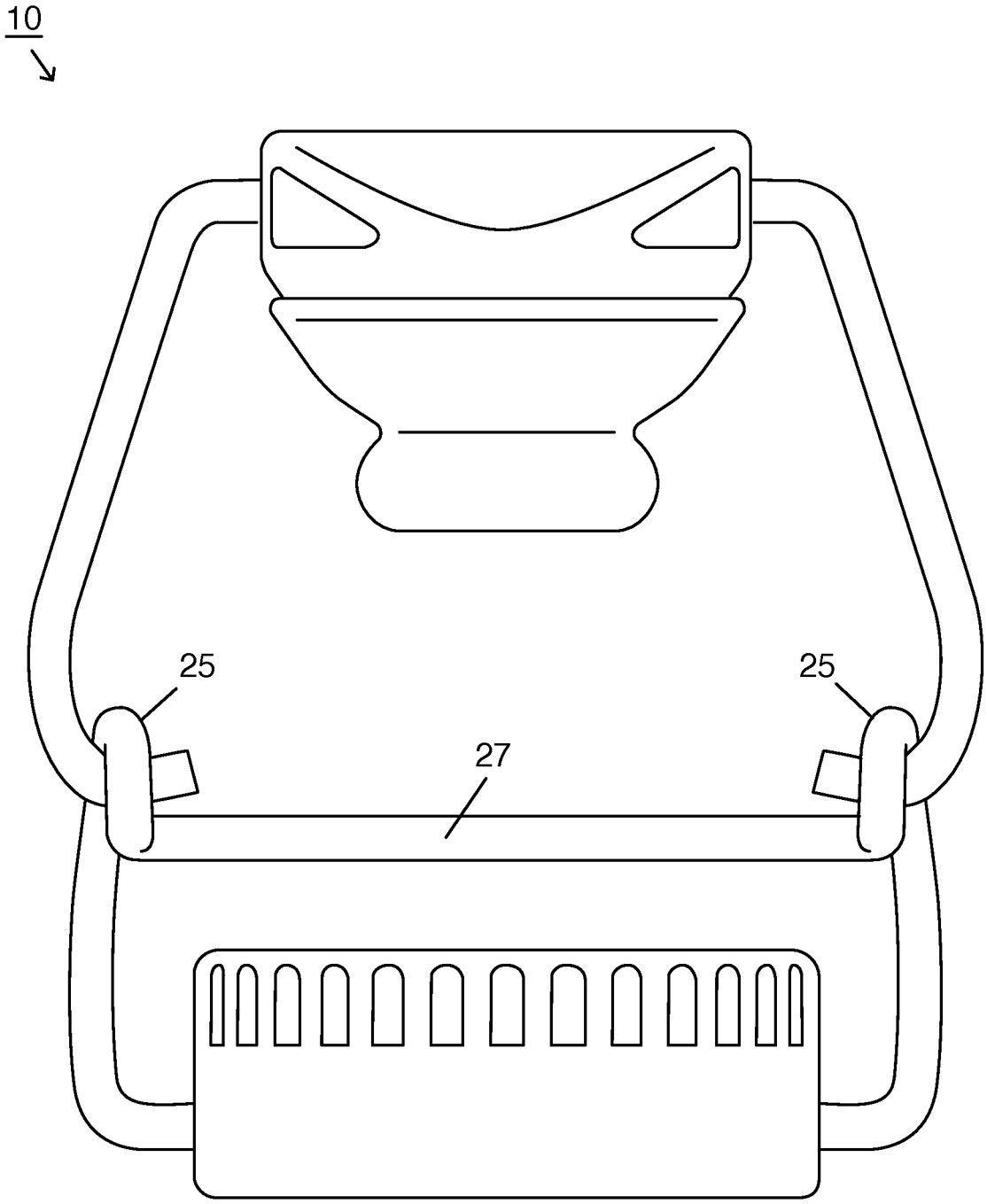
FIG. 2 is a back view of a closure device.

Referring to FIG. 1, a preferred embodiment of closure device 10 generally includes stopper assembly 50 pivotably connected to bail wire 30, engaged with lever wire 20, which is inserted into adaptor 40.

Figure 7:
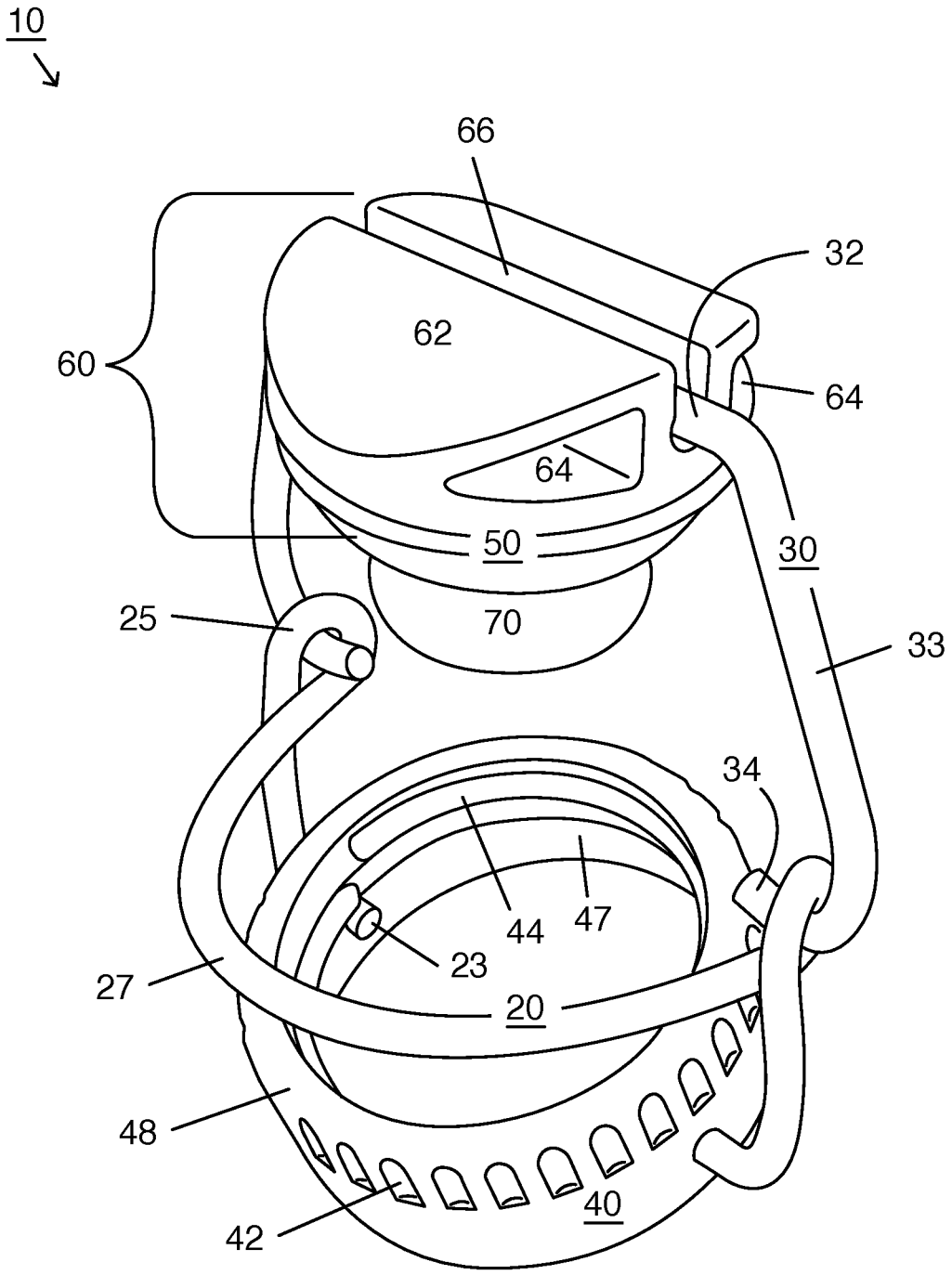
FIG. 7 is a perspective view of a closure device.
Figure 10:
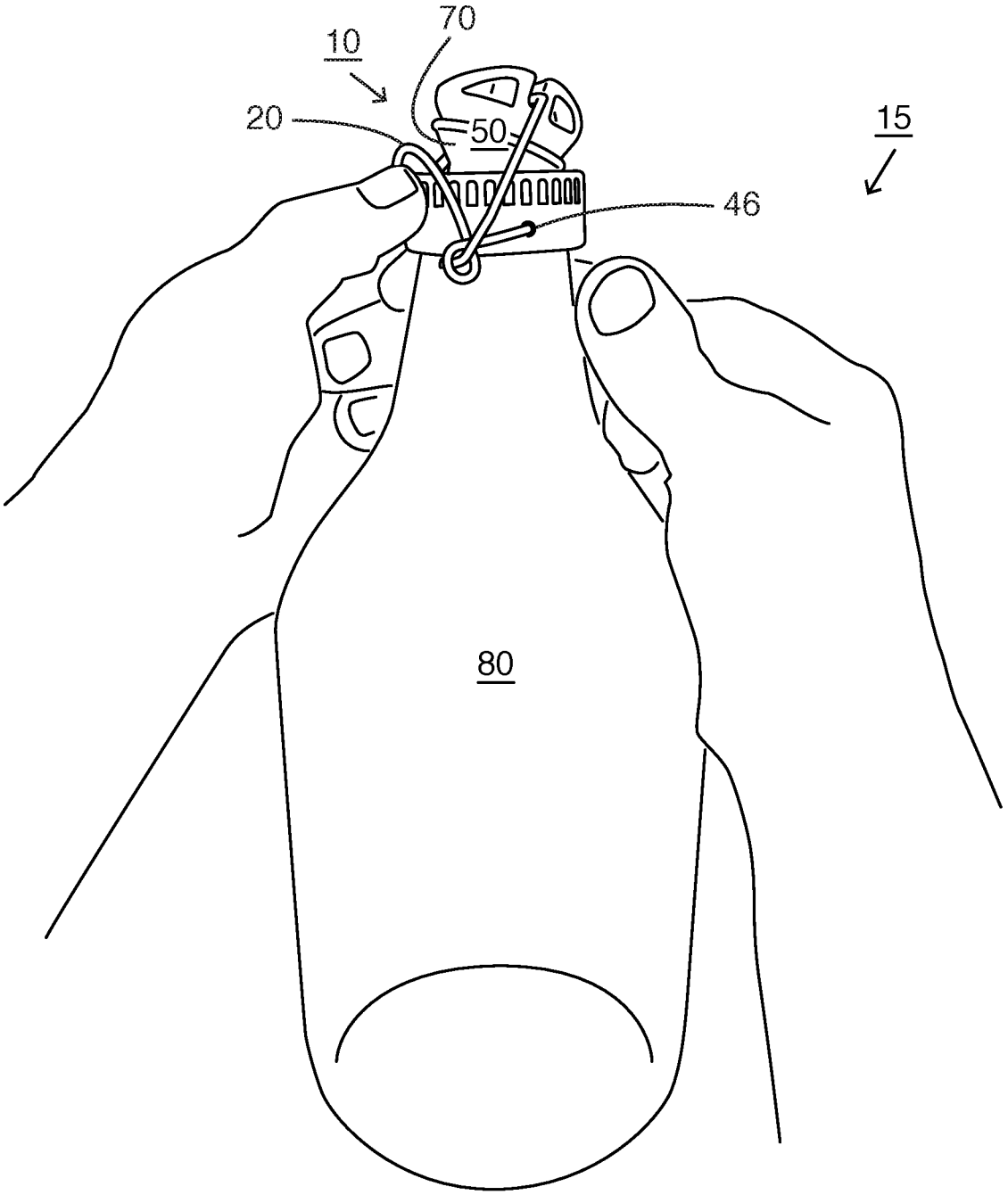
FIG. 10 depicts a user opening a closure device on a vessel.

Referring closer to stopper assembly 50, lid 60 generally forms the upper portion, while plug 70 generally forms the lower portion, although it should be understood that central portion 32 of bail wire 30 forms an axis around which the entire stopper assembly 50 can rotate, as best shown in FIG. 7. Accordingly, the relative position of the upper portion and lower portion can change, although plug 70 is configured for insertion into neck 81 of vessel 80, and therefore would normally be positioned underneath lid 60 when closing a vessel, as shown in FIG. 10.

Figure 3:
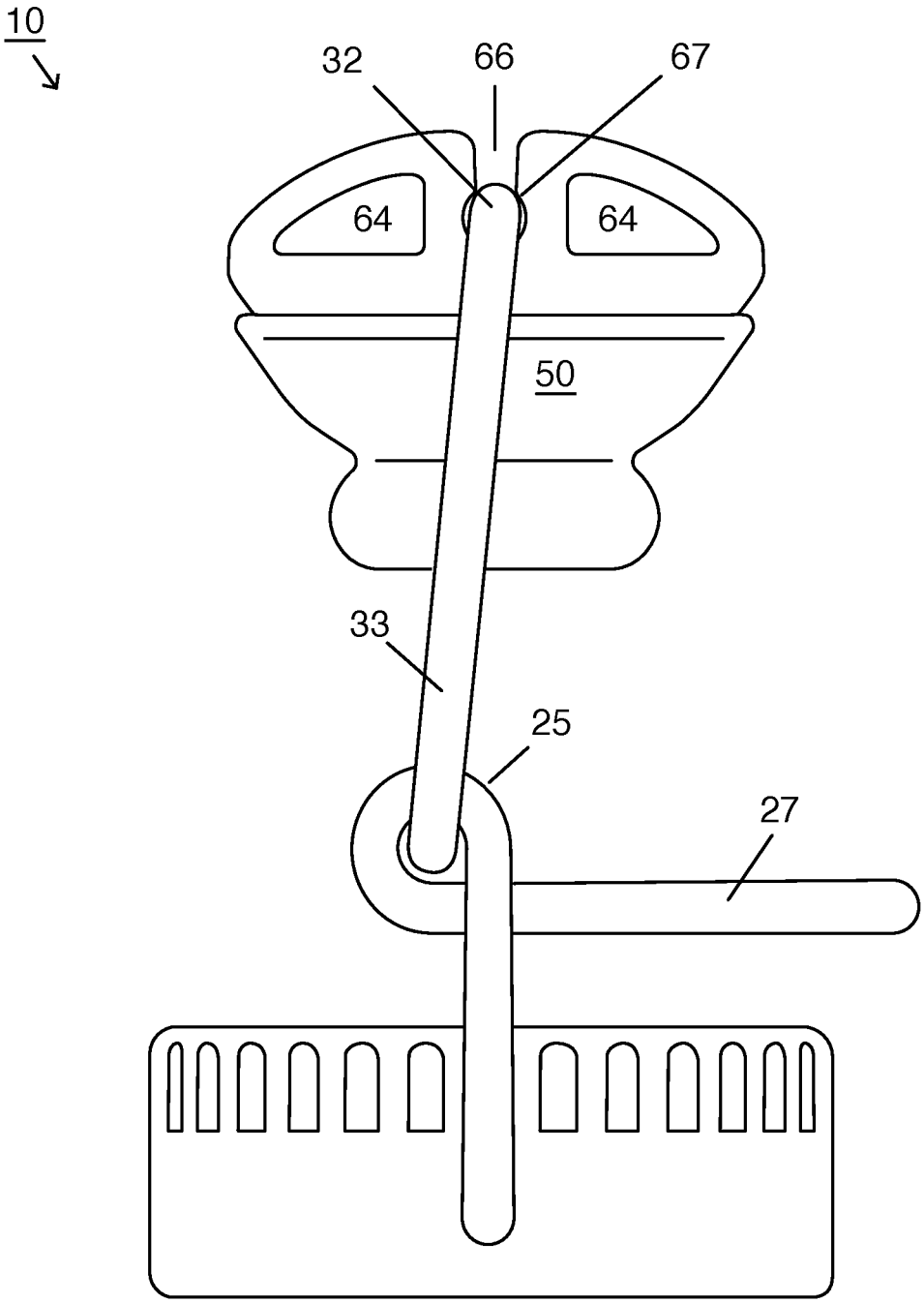
FIG. 3 is a left side view of a closure device.
Figure 4:
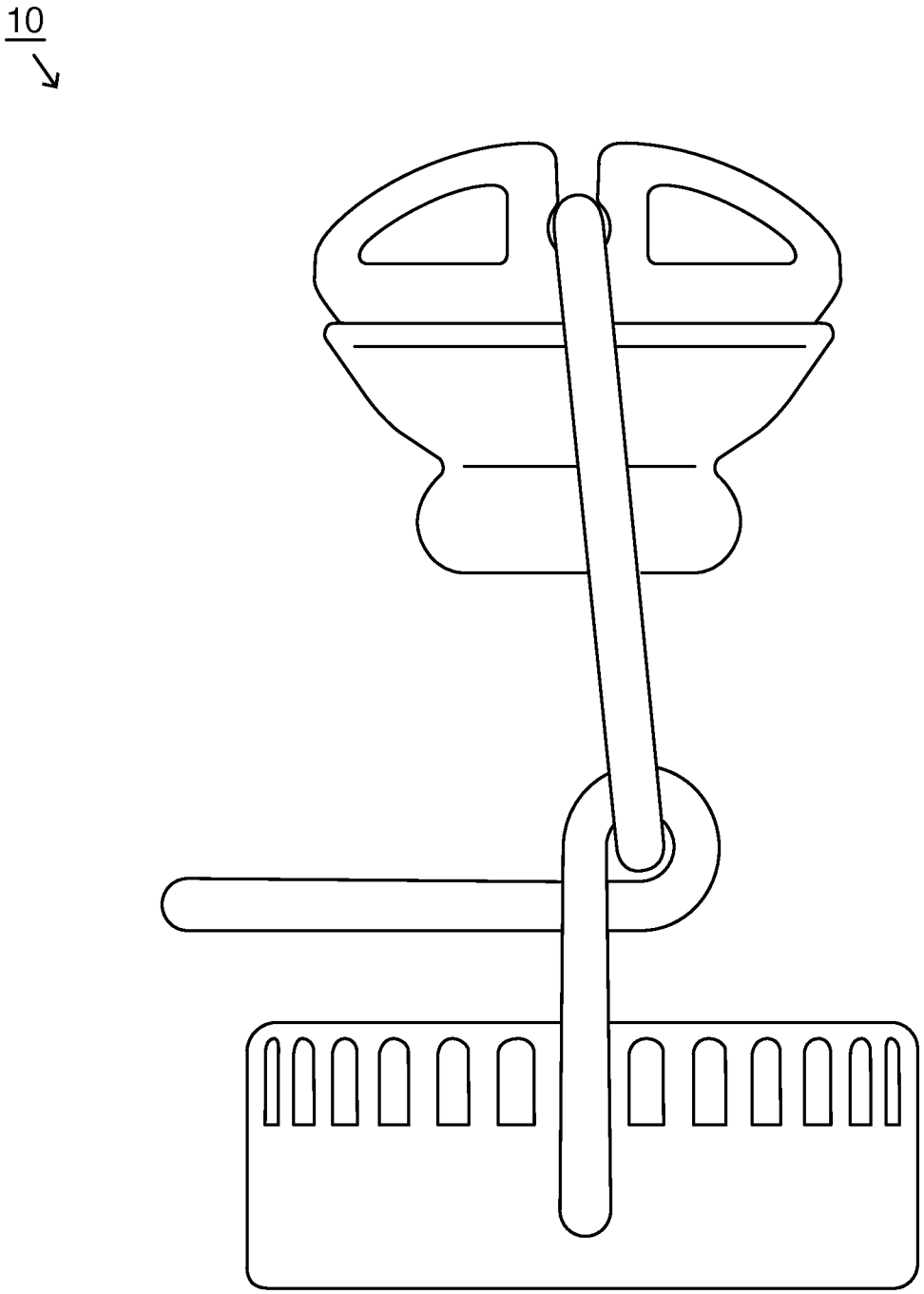
FIG. 4 is a right side view of a closure device.
Figure 5:
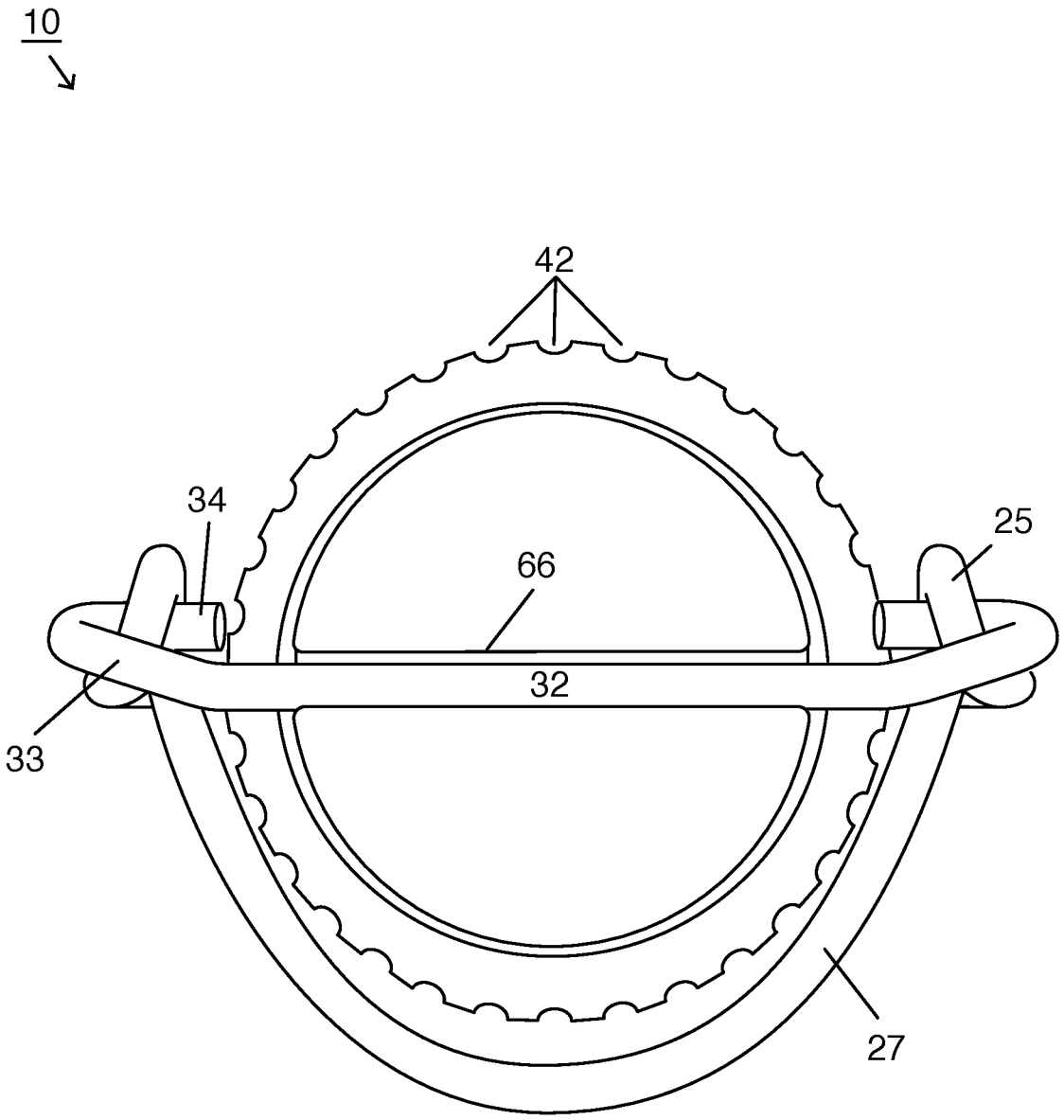
FIG. 5 is a top view of a closure device.
Figure 6:
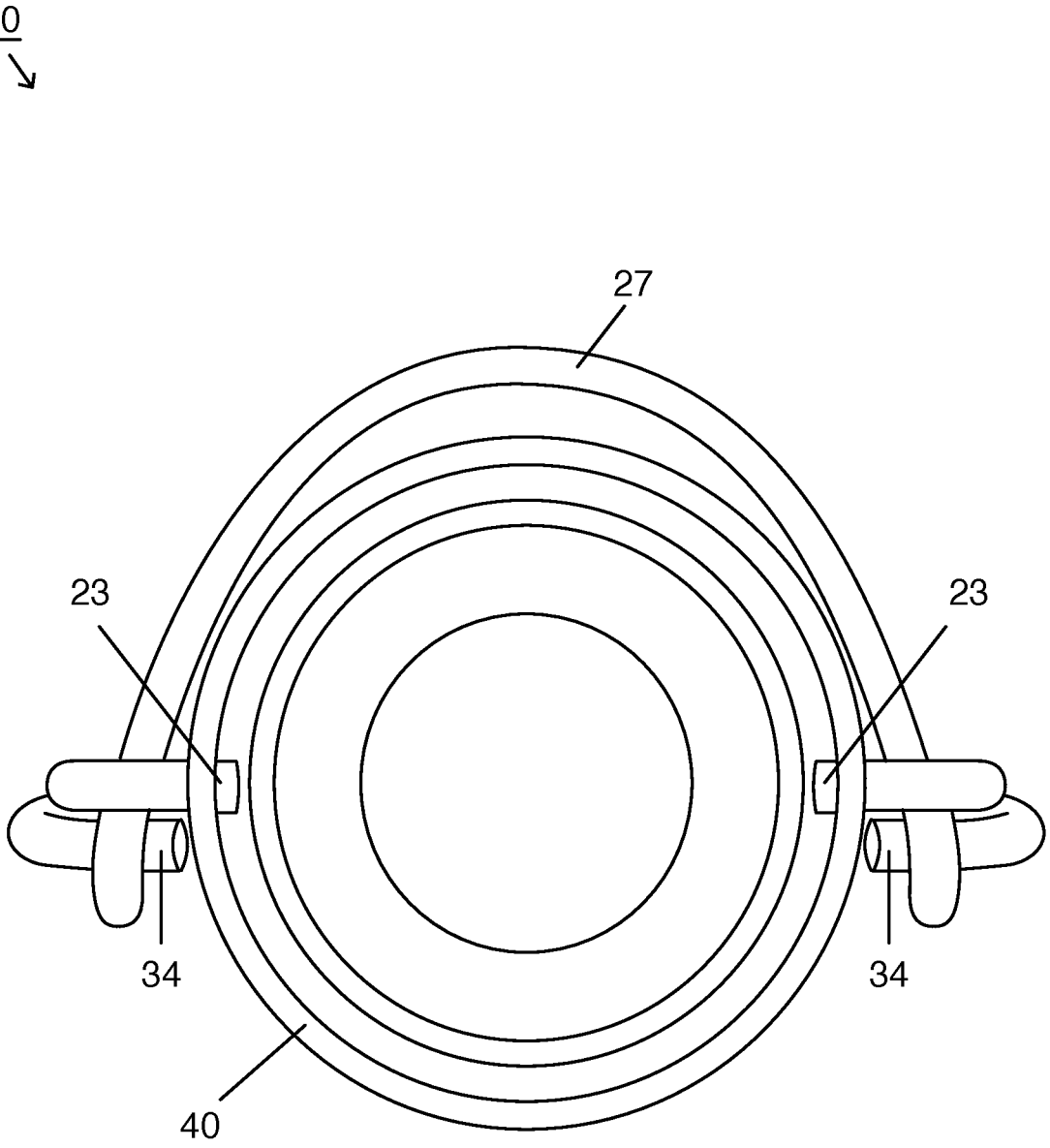
FIG. 6 is a bottom view of a closure device.

Referring to FIG. 7, lid 60 generally includes downwardly sloping upper surface 62, with groove 66 positioned substantially centrally. As best shown in FIG. 3, groove 66 is configured to releasably mechanically engage central portion 32 of bail wire, and preferably defines wide base 67 to allow smooth rotation of stopper assembly 50. Lid 60 preferably defines a plurality of indentations 64, preferably four separate indentations, or two indentations each traversing the lid.

Stopper assembly 50 is preferably formed of injection molding using high density polyethylene (HDPE). Alternative manufacturing methods and materials include 3D printing in PLA plastic, ABS plastic or other printable material; urethane casting; and combinations thereof. As best shown in FIG. 1, outer surface of plug 70 is defined by bottom portion of stopper assembly, and preferably includes covered region 68. Covered region is preferably constructed of a pliable material such as rubber or silicone, and is approximately 1.5 to 2 mm thick, and functions to provide a tight fit between plug and vessel.

Although the dimensions of stopper assembly 50 can vary according to the vessel with which it is to be used, a standard stopper assembly for use with a 38/400 growler vessel would preferably be approximately 50 mm tall and approximately 50 mm wide. Opening and extending the assembled parts to their full reach would be approximately 90 mm high with the width approximately 52 mm.

As best shown in FIG. 7, stopper assembly 50 is connected to adaptor 40 by bail wire 30 and lever wire 20. More specifically, bail wire 30 is engaged with stopper assembly 50 as described above, while apertures 46 (see FIG. 10) of adaptor 40 receive protruding portion 23 of lever wire 20. Apertures 46 are preferably positioned approximately 180° apart one from the other. Engaging termini 34 of bail wire 30 is releasably engaged with loop 25 of lever wire 20. This configuration creates three separate pivot points: central portion 32 relative to groove 66; bail wire 30 relative to lever wire 20; and lever wire 20 relative to adaptor 40. As would be understood by those in the art, bail wire 30 can be disengaged from lever wire 20 by removing engaging termini 34 from loops 25. Similarly, lever wire 20 can be removed from adaptor 40 by withdrawing protruding portions 23 from apertures 46.

Referring still to FIG. 7, adaptor 40 preferably defines a plurality of gripping divots 42 around the outer circumference 48 which assist a user in grasping and rotating the adaptor. Inner circumference 47 of adaptor 40 defines threads 44 which correspond with vessel threads 83 of vessel 80. In a preferred embodiment, vessel 80 has a 38/400 vessel threads 83, and adaptor 40 defines a 38/400 thread pattern for threads 44, although other configurations are squarely within the scope of this invention. Adaptor 40 is preferably formed of injection molding using high density polyethylene (HDPE). Alternative manufacturing methods and materials include 3D printing in PLA plastic, ABS plastic or other printable material; urethane casting; and combinations thereof.

Figure 8:
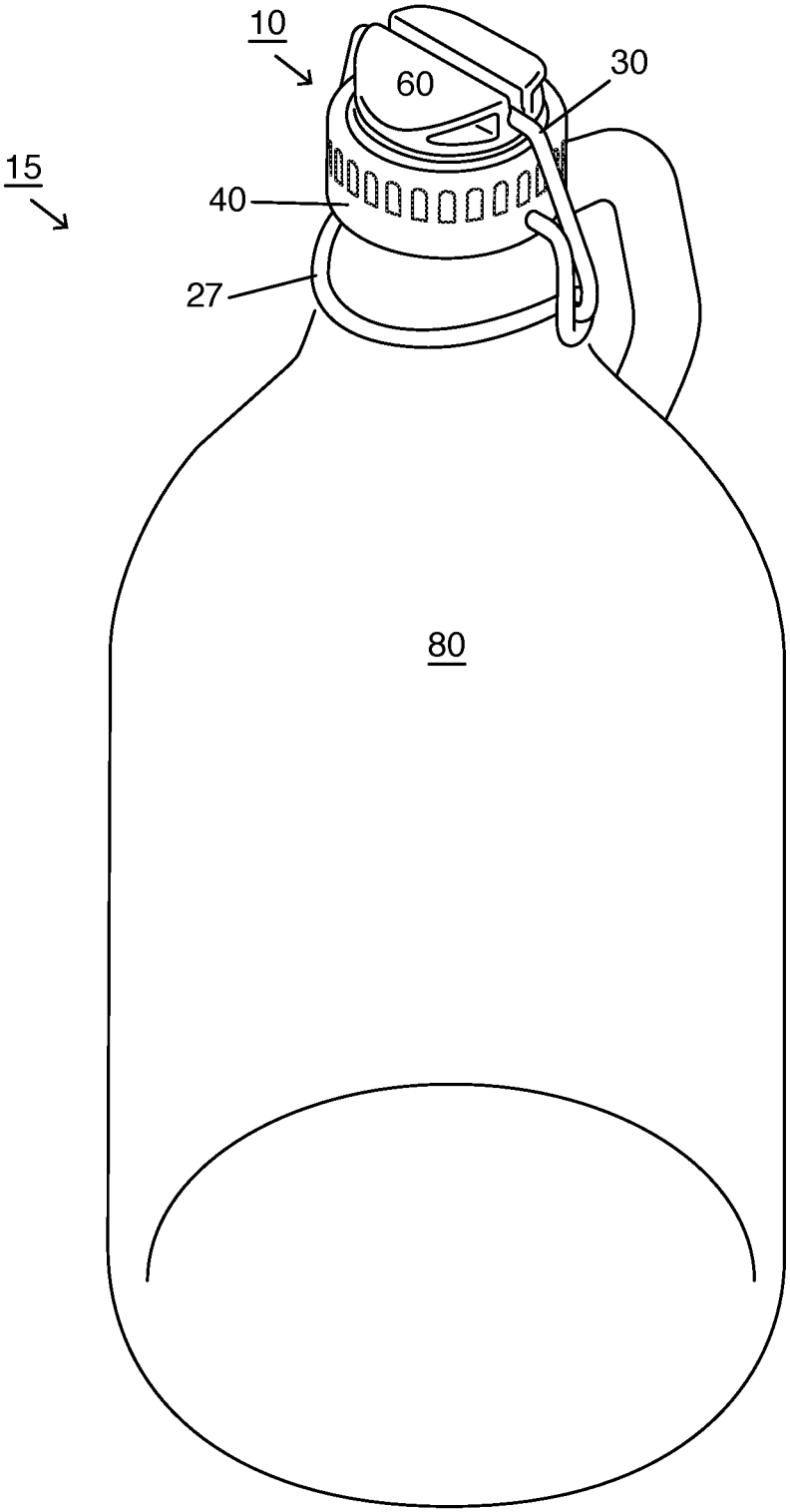
FIG. 8 is a perspective view of a closure system with the closure device in the closed position.
Figure 9:
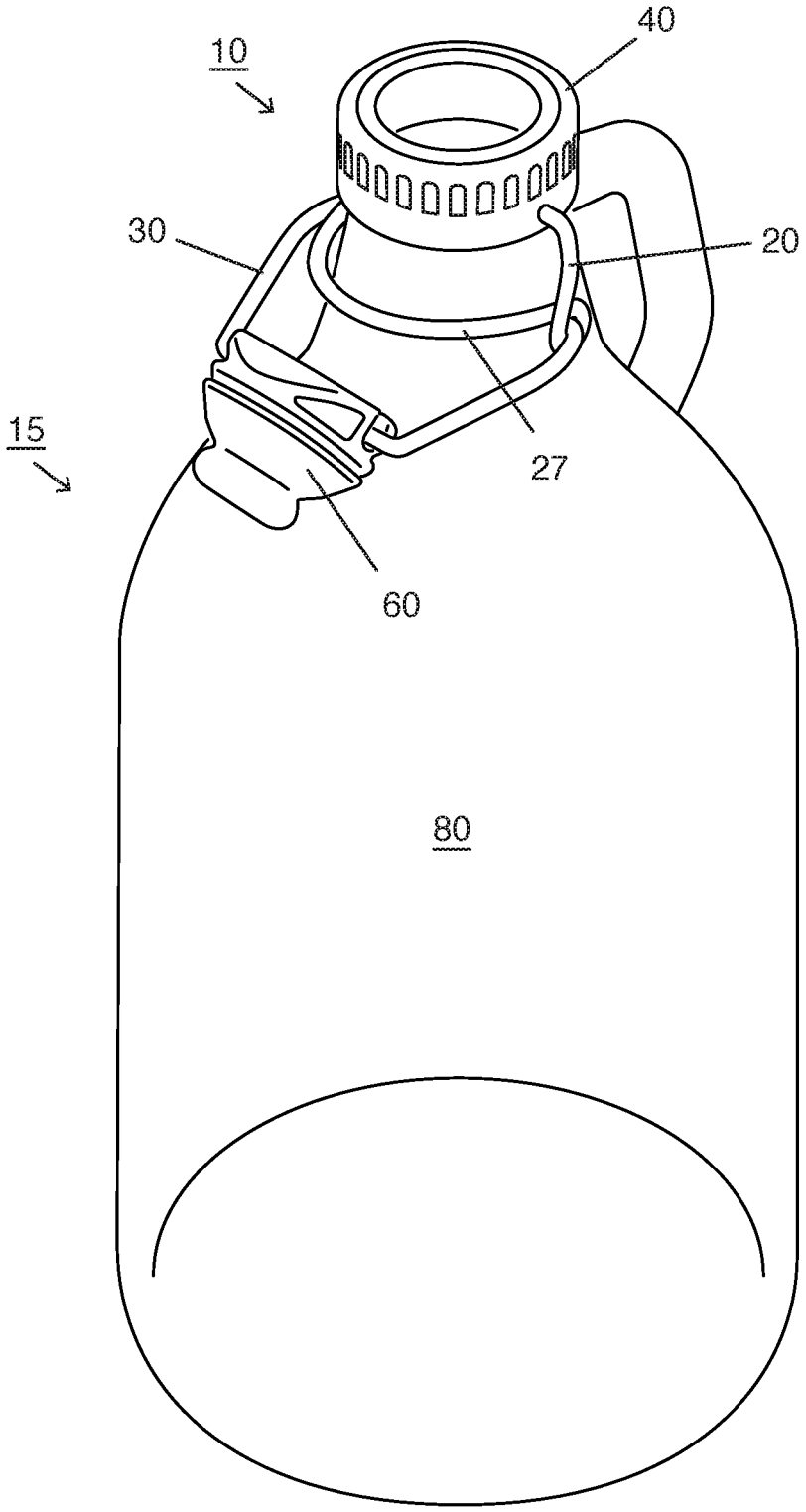
FIG. 9 is a perspective view of a closure system with the closure device in the opened position.
Figure 11:
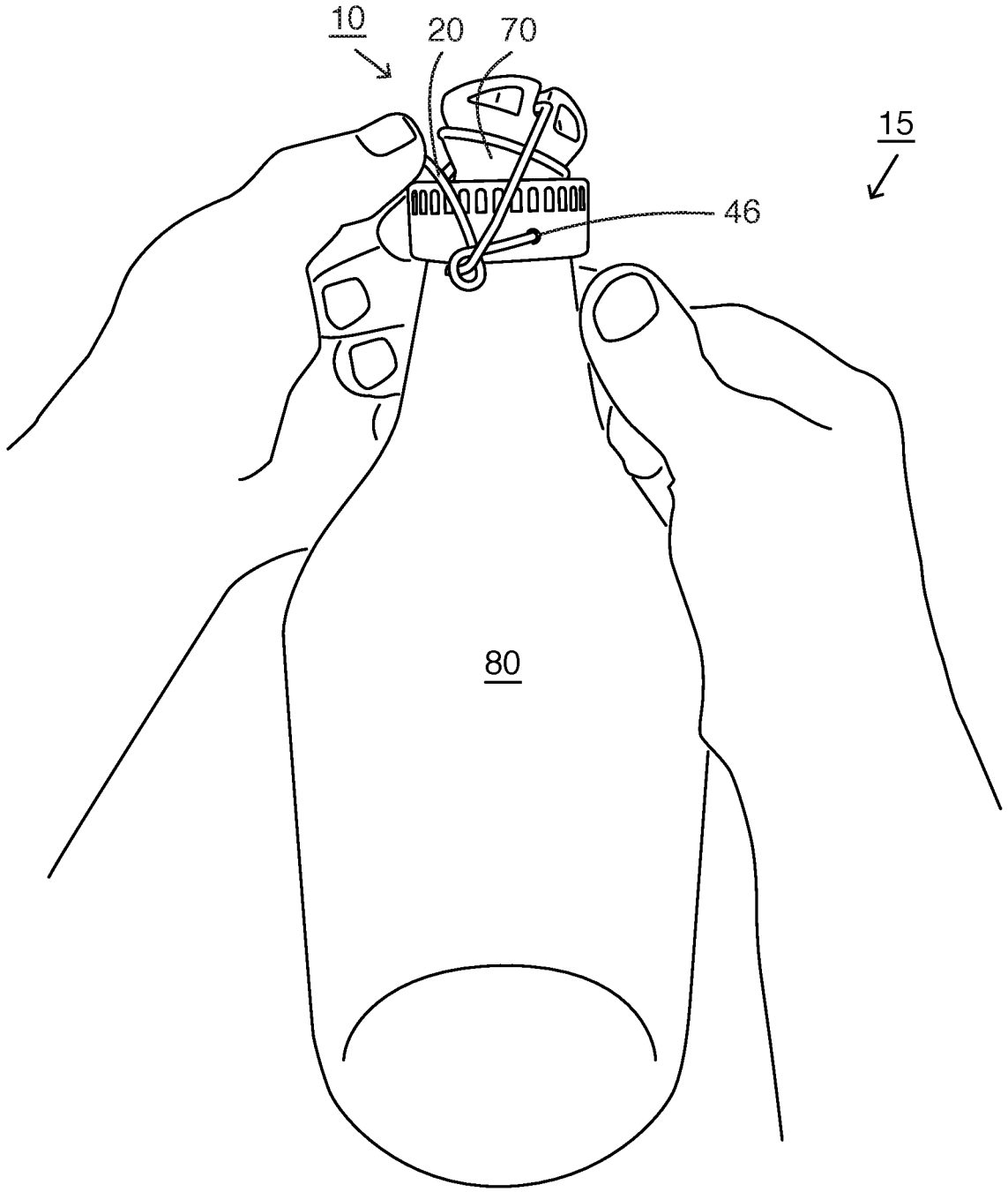
FIG. 11 depicts a user closing a closure device on a vessel.

FIG. 8 depicts closure device 10 in completely closed position on vessel 80, while FIG. 9 depicts closure device in completely opened position on the vessel. FIG. 10 depicts closure device 10 being opened, as evidenced by the user's hand pivoting lever wire 20 upwardly, thereby releasing downward tension on stopper assembly 50 and allowing plug 70 to withdraw from vessel 80. Conversely, FIG. 11 depicts closure device 10 being closed, as evidenced by the user's hand pivoting lever wire 20 downwardly, thereby lowering plug 70 into vessel 80.

FIG. 12 depicts a method of using a closure device of the present invention, with FIGS. 12A-12D detailing some critical steps. Referring to FIG. 12A, a user engages closure device 10 with vessel 80 by rotating adaptor 40, as one would normally engage a screw cap with the threaded lid of a vessel. In the illustrated example, stop ring 82, which is defined by vessel 80, presents an obstacle for protruding portion 23. Said another way, adaptor 40 cannot be screwed all the way on because protruding portion 23 is stopped by stop ring 82. As would be understood by those in the art, stop rings vary in size, and it would therefore be expected that protruding portion 23 would sometimes get stuck on a stop ring, depending on the particular configuration of the vessel.

As shown in FIG. 12B, lever wire 20 is removed from adaptor 40 by withdrawing protruding portions 23 from apertures 46. This allows adaptor 40 to fully downwardly engage with vessel, without interference between protruding portion 23 and stop ring 82.

As shown in FIG. 12C, adaptor 40 is screwed all the way down, with apertures 46 are positioned beneath stop ring 82. As shown in FIG. 12D, lever wire 20 is reinserted into adaptor 40, with protruding portions 23 positioned beneath stop ring 82. In this manner stop ring 82 provides some leverage when lever wire 20 is subjected to force. It is noted that the outside surface of adaptor 40 is not shown in FIGS. 12A, 12C and 12D in order to more clearly describe the interaction of underlying structures.

Inventions disclosed herein include closure device 10, and closure system 15 which includes both closure device 10 and vessel 80. Closure system 15 is shown in FIGS. 8-11.

It should be understood that the foregoing relates to exemplary embodiments of the invention and that modifications may be made without departing from the spirit and scope of the invention as set forth in the following claims. By way of example, the application elaborates on a closure device and system for use with vessels such as growlers commonly used for brewed beverages such as beer, but essentially the same device could be used with other threaded vessels such as jars, jugs and bottles. Terms such as "substantially" and the like shall mean within reasonable bounds when considering limitations such as machines, materials, manufacturing methods, and people. By way of example, a "substantially smooth" surface means there are no intentional bumps or irregularities. All ranges set forth herein include the endpoints as well as all increments there between, even if not specifically stated. By way of example 1 to 2 inches includes 1 inch, 1.000001 inches and so forth. Finally, unless otherwise stated or contrary to common sense, "approximate" and the like shall mean +/−10%.

What is claimed is:

1. A closure device including:

A. A stopper assembly;

B. A bail wire rotatably engaged with said stopper assembly;

C. A lever wire engaged with said bail wire; and

D. An adaptor having an outer circumference and an inner circumference and defining two apertures spanning the outer circumference to the inner circumference of said adaptor wherein said lever wire terminates in two protruding portions releasably engaged with said apertures, wherein said inner circumference defines a plurality of threads configured to engage with compatible threads on the outer neck surface of a vessel and wherein said protruding portions terminate inwardly of said inner circumference and below a stop ring defined by said outer neck surface.

2. The closure device of claim 1 wherein said stopper assembly defines a groove traversing an upper surface, said groove configured to releasably engage said bail wire.

3. The closure device of claim 2 wherein said bail wire is a unitary wire.

4. The closure device of claim 1 wherein said lever wire forms two loops, said bails wire engaged with said loops.

5. The closure device of claim 1 wherein said two apertures are positioned substantially 180° one from the other.

6. The closure device of claim 1 wherein said plurality of threads define a 38/400 thread pattern.

7. A closure system including:

A. A vessel having a neck defining a stop ring and a plurality of vessel threads; and B. A closure device including stopper assembly; a bail wire rotatably engaged with said stopper assembly; a lever wire engaged with said bail wire; and an adaptor having a plurality of threads engaged with said vessel threads and defining two apertures spanning the outer circumference to the inner circumference of said adaptor wherein said lever wire terminates in two protruding portions releasably engaged with said apertures such that said protruding portions terminate inwardly of said inner circumference and below said stop ring, wherein said stopper assembly is configured to enter into and withdraw from said neck.

8. The closure system of claim 7 wherein said vessel is a beer growler.

9. A method of closing a vessel including the acts of:

A. Removing a lever wire from an adaptor of a closure device;

B. Positioning said adaptor on the neck of a vessel having vessel threads;

C. Rotating said adaptor to engage threads of said adaptor with said vessel threads of said vessel;

D. Aligning a stopper assembly of said closure device to a position adjacent said neck; and E. Pivoting said lever wire of said closure device to insert said stopper assembly into said neck.

10. The method of claim 9 further comprising the act of reinserting said lever wire into said adaptor prior to pivoting said lever wire.

11. The method of claim 9 further comprising the act of upwardly pivoting said lever wire to withdraw said stopper assembly from said neck.

* * * * *